US005188548A

United States Patent [19]

Ferguson et al.

[11] Patent Number: 5,188,548

[45] Date of Patent: Feb. 23, 1993

[54] MARINE PROPULSION DEVICE MOUNTING ARRANGEMENT

[75] Inventors: Arthur R. Ferguson, Northbrook; Edgar Rose, Glencoe, both of Ill.

[73] Assignee: Outboard Marine Corporation, Waukegan, Ill.

[21] Appl. No.: 799,729

[22] Filed: Nov. 22, 1991

Related U.S. Application Data

[63] Continuation of Ser. No. 638,387, Jan. 4, 1991, abandoned.

[51] Int. Cl.[5] ..... B63H 5/12

[52] U.S. Cl. ..... 440/61; 248/291; 248/640; 440/53; 440/900

[58] Field of Search ..... 248/640, 641, 642, 643, 248/121, 278, 291; 440/900, 53, 61; 114/355, 356, 358

[56] References Cited

U.S. PATENT DOCUMENTS

| | | | |
|---|---|---|---|
| 2,138,600 | 11/1938 | Harmon . | |
| 3,145,003 | 8/1964 | Hart . | |
| 3,245,640 | 4/1966 | Ibbs . | |
| 3,269,351 | 8/1966 | Shimanckas | 115/18 |
| 3,452,704 | 7/1969 | Watkins | 115/41 |
| 3,604,674 | 9/1971 | Wilkerson . | |
| 3,629,885 | 12/1971 | Jackson . | |
| 3,702,485 | 11/1972 | Thompson . | |
| 3,763,810 | 10/1973 | Payne . | |
| 3,809,343 | 5/1974 | Adams et al. . | |
| 4,302,195 | 11/1981 | Bryant | 440/61 |
| 4,348,972 | 9/1982 | Parsons | 114/61 |
| 4,354,847 | 10/1982 | Blanchard | 440/61 |
| 4,354,848 | 10/1982 | Hall et al. | 248/642 X |
| 4,355,986 | 10/1982 | Stevens | 440/53 |
| 4,363,629 | 12/1982 | Hall et al. | 248/642 X |
| 4,367,860 | 1/1983 | Strang | 248/641 |
| 4,384,856 | 5/1983 | Hall et al. | 248/642 X |
| 4,406,632 | 9/1983 | Blanchard | 248/642 X |
| 4,492,176 | 1/1985 | Arima | 114/56 |
| 4,584,959 | 4/1986 | Allison | 114/288 |
| 4,654,014 | 3/1987 | Peirce et al. | 248/642 X |
| 4,666,410 | 5/1987 | Anselm | 440/61 |
| 4,698,035 | 10/1987 | Fergunson | 440/61 |
| 4,742,795 | 5/1988 | DePrey et al. | 114/362 |
| 4,781,136 | 11/1988 | Van Der Velden | 114/56 |
| 4,828,186 | 5/1989 | Weiss | 248/642 X |
| 4,836,811 | 6/1989 | Griffiths et al. | 248/642 |

*Primary Examiner*—Ramon O. Ramirez
*Attorney, Agent, or Firm*—Michael, Best & Friedrich

[57] ABSTRACT

A boat comprising a hull including a transom having laminations, a support plate fixed between a pair of laminations, a pair of horizontally spaced apart pivot pin supports each extending rearwardly from the support plate and each including an outer end projecting outwardly from the transom, a tilt pivot pin having a generally horizontal longitudinal axis, and extending between the outer ends, a mounting apparatus adapted to support an outboard motor on the tilt pivot pin, the mounting apparatus including a mounting bracket having an apparatus for supporting the outboard motor for pivotal movement about a generally vertical steering axis, and a semi-cylindrical surface, a pivot cap including a semi-cylindrical surface which cooperates with the semi-cylindrical surface of the mounting bracket to define a passage pivotally receiving the tilt pivot pin, a screw for releaseably fastening the pivot cap on the mounting bracket, and a mechanism for pivoting the mounting bracket about the longitudinal axis.

31 Claims, 1 Drawing Sheet

MARINE PROPULSION DEVICE MOUNTING ARRANGEMENT

This is a continuation of co-pending application Ser. No. 638,387, filed Jan. 4, 1991 now abandoned.

BACKGROUND OF THE INVENTION

1. Field of the Invention

The invention relates generally to marine craft such as boats and to marine propulsion devices mounted thereon. More particularly, the invention relates to arrangements for mounting an outboard motor on a tilt pivot pin which is supported on the transom of a boat.

2. Reference to the Prior Art

Outboard motors generally include a transom bracket for mounting the outboard motor on the transom of a boat. The transom bracket is commonly secured to the transom by bolts or by manually operable screw clamps. A tilt pivot pin is supported by the transom bracket, and a swivel bracket is mounted on the tilt pivot pin for pivotal movement of the swivel bracket about the axis of the tilt pivot pin. The propulsion unit of the outboard motor is supported on the swivel bracket for movement therewith about the axis of the tilt pin, and for movement relative to the swivel bracket about a generally vertical steering axis.

Attention is directed to the following U.S. patents:

| Patent No. | Inventor | Issued |
|---|---|---|
| 2,138,600 | Harmon | November 29, 1938 |
| 3,145,003 | Hart | August 18, 1964 |
| 3,245,640 | Ibbs | April 12, 1966 |
| 3,269,351 | Shimanckas | August 30, 1966 |
| 3,604,674 | Wilkerson | September 14, 1971 |
| 3,629,885 | Jackson | December 28, 1971 |
| 3,702,485 | Thompson | November 14, 1972 |
| 3,809,343 | Adams et al. | May 7, 1974 |
| 4,302,195 | Bryant | November 24, 1981 |
| 4,348,972 | Parsons | September 14, 1982 |
| 4,354,847 | Blanchard | October 19, 1982 |
| 4,355,986 | Stevens | October 26, 1982 |
| 4,367,860 | Strang | January 11, 1983 |
| 4,492,176 | Arima | January 8, 1985 |
| 4,742,795 | DePrey | May 10, 1988 |

SUMMARY OF THE INVENTION

The invention provides a mounting apparatus for mounting an outboard motor on the hull of a boat, the hull having mounted thereon a generally horizontal tilt pivot pin having a longitudinal axis, the mounting apparatus comprising a mounting bracket including means for supporting the outboard motor for pivotal movement about a generally vertical steering axis, means for mounting the mounting bracket on the tilt pivot pin for pivotal movement about the longitudinal axis, the mounting means including a pivot cap cooperating with the mounting bracket to define a first passage adapted to pivotally receive the tilt pivot pin, and means for releaseably fastening the pivot cap on the mounting bracket.

The invention also provides a boat comprising a hull including a transom, a pivot pin apparatus integrated into the transom and including a support member and a pair of horizontally spaced apart pivot pin supports each extending rearwardly from the support member and each including an outer end projecting outwardly from the transom, and a tilt pivot pin having a generally horizontal longitudinal axis, being adapted to support an outboard motor for pivotal movement about the longitudinal axis, and extending between the outer ends.

The invention also provides a marine apparatus comprising a boat hull including opposed walls extending generally in the fore and aft direction, and means connected to the walls for supporting a propulsion unit for pivotal movement relative to the boat about a generally horizontal axis, the means including a mounting apparatus having therein a king pin bore defining a generally vertical steering axis.

The invention also provides a marine apparatus comprising a boat hull including opposed walls extending generally in the fore and aft direction, and means for supporting a propulsion unit for pivotal movement relative to the boat about a generally horizontal axis intersecting the walls, the means including a mounting apparatus having therein a king pin bore defining a generally vertical steering axis.

The invention also provides a mounting bracket for mounting an outboard motor propulsion unit on a boat for pivotal movement relative thereto about a generally horizontal tilt axis, the bracket comprising a portion having therein a king pin for receive a king pin adapted to and bearing means adapted to be connected to boat walls extending generally perpendicular to the tilt axis.

The invention also provides a boat comprising a hull including a transom having pair of horizontally spaced apart rearwardly extending projections, and a tilt pivot pin having a generally horizontal longitudinal axis, being adapted to support an outboard motor for pivotal movement about said longitudinal axis, and extending between the projections.

The invention also provides a boat comprising a hull including a transom having laminations, a support plate fixed between a pair of laminations, a pair of horizontally spaced apart pivot pin supports each extending from the support plate and each including an outer end projecting rearwardly form the transom, a tilt pivot pin having a generally horizontal longitudinal axis, and extending between the outer ends, a mounting apparatus adapted to support an outboard motor on the tilt pivot pin, the mounting apparatus including a mounting bracket having means for supporting the outboard motor for pivotal movement about a generally vertical steering axis, and a semi-cylindrical surface, a pivot cap including a semi-cylindrical surface which cooperates with the semi-cylindrical surface of the mounting bracket to define a passage pivotally receiving the tilt pivot pin, and means for releaseably fastening the pivot cap on the mounting bracket, and means for selectively pivoting the mounting bracket about the longitudinal axis, the pivoting means including a piston and cylinder assembly pivotally interconnected between the transom and the mounting bracket.

A principal feature of the invention is the provision of a boat having a tilt pivot pin which is integrated into the transom, and a mounting apparatus for releaseably mounting an outboard motor on the tilt pivot pin for pivotal movement about the generally horizontal axis of the pin, and for pivotal movement about a generally vertical steering axis.

Another principal feature of the invention is the provision of means connected to opposed walls extending generally in the fore and aft direction for supporting a propulsion unit for pivotal movement about a generally horizontal tilt axis. This means is preferably a mounting bracket including bearing means adapted to be connected to boat walls extending generally perpendicular to the tilt axis.

Other features and advantages of the invention will become apparent to those skilled in the art upon review of the following detailed description, claims, and drawings.

Figure 1:
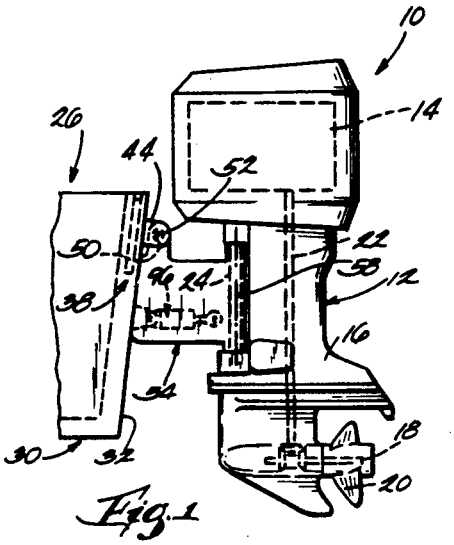
FIG. 1 is a side elevational, partially schematic view of a marine installation embodying various features of the invention.

Before one embodiment of the invention is explained in detail, it is to be understood that the invention is not limited in its applications to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

A marine installation is illustrated in the drawings and embodies various features of the invention.

As shown in FIG. 1, the marine installation comprises a marine propulsion device 10 which is preferably in the form of an outboard motor. The outboard motor 10 includes a propulsion unit 12 having an internal combustion engine 14 (shown schematically in FIG. 1), a lower unit 16 carrying a rotatably mounted propeller shaft 18 which supports a propeller 20 and which is drivingly connected to the engine 14 by a conventional drive train 22, and a king pin 24 connected to the lower unit 16 in a conventional manner.

The marine installation also comprises a boat 26. The boat 26 includes a hull 30 having a transom 32. The transom 32 (see FIG. 2) is preferably a laminate formed of a plurality of laminations 34.

Figure 2:
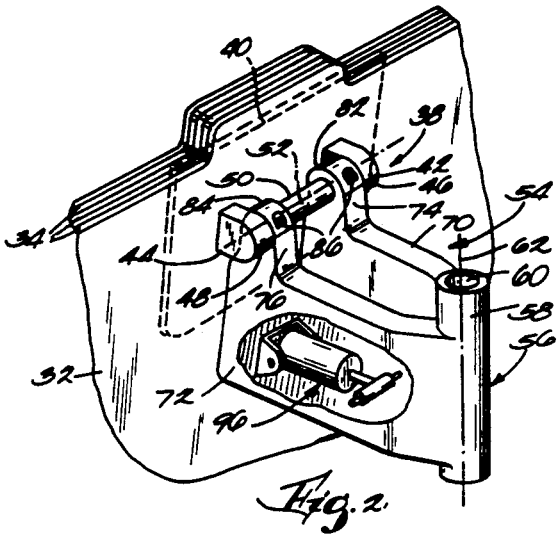
FIG. 2 is an enlarged perspective view, partially in section, of the mounting arrangement shown in FIG. 1
Figure 4:
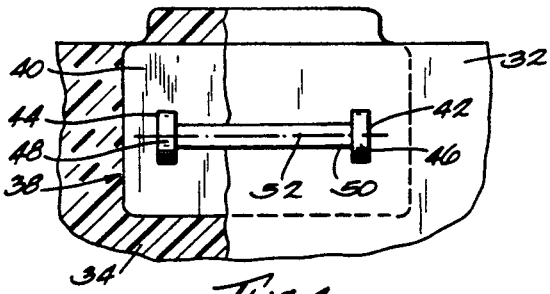
FIG. 4 is a rear view, partially in section, of the tilt pivot pin arrangement shown in FIG. 2

The marine installation also comprises means for supporting the outboard motor 10 on the transom 32. While various supporting means can be employed, in the illustrated construction such means includes a pivot pin apparatus 38 which is integrated into the transom 32. As shown in FIGS. 2 and 4, the pivot pin apparatus 38 includes a support member or plate 40 firmly fixed between a pair of laminations 34. A pair of horizontally spaced apart pivot pin supports 42 and 44 extend rearwardly from the support plate 40 and include respective outer ends 46 and 48 which project outwardly from the transom 32. A tilt pivot tube or pin 50 extends between the supports 42 and 44 and includes a generally horizontal, longitudinal axis 52, herein referred to as the tilt axis. The tilt pivot pin 50 supports the outboard motor 10 for pivotal movement about the tilt axis 52, as will be further explained below.

Figure 3:
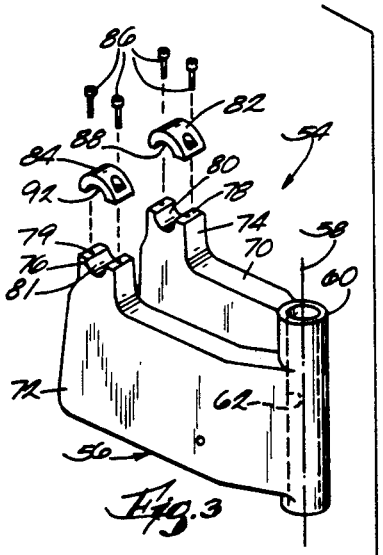
FIG. 3 is an exploded view of the mounting arrangement shown in FIG. 2.

The means for supporting the outboard motor 10 also includes a mounting apparatus 54 for releaseably mounting the outboard motor 10 on the tilt pivot pin 50. As shown in FIG. 3, the mounting apparatus 54 includes a mounting bracket 56. The bracket 56 includes means for mounting the propulsion unit 12 thereon for pivotal movement about a generally vertical steering axis 58. While various mounting means can be employed, in the illustrated arrangement, such means includes a generally upstanding cylindrical member 60 which has therein a cylindrical king pin bore 62 centered on the steering axis 58. The propulsion unit 12 is connected to the mounting bracket 56 by the king pin 24, which is received in the bore 62 so that the generally vertical axis of the king pin 24 is coincident with the steering axis 58. This arrangement affords pivotal movement of the propulsion unit 12 relative to the mounting bracket 56 about the steering axis 58.

As shown in FIG. 3, the bracket 56 also includes a pair of members 70 and 72 which extend forwardly from the cylindrical member 60. In the illustrated arrangement the members 70 and 72 are mirror images of one another and respectively include generally upwardly projecting extensions 74 and 76. The extensions 74 and 76 respectively include upper ends 78 and 79. The upper ends 78 and 79 include respective semi-cylindrical surfaces 80 and 81.

The means for supporting the outboard motor 10 also includes means for mounting the bracket 56 on the tilt pivot pin 50 for tilting movement about the tile axis 52. While various mounting means can be employed, in the illustrated arrangement, such means includes (see FIG. 3) a pair of pivot caps 82 and 84. Suitable means such as screws 86 are provided for releaseably fastening the pivot caps 82 and 84 on the upper ends 78 and 79, respectively. The pivot cap 82 includes a semi-cylindrical surface 88 which cooperates with the semi-cylindrical surface 80 of the upper end 78 to define a first cylindrical passage for pivotally receiving the tilt pivot pin 50. Likewise, the pivot cap 84 and includes a semi-cylindrical surface 92 cooperating with the semi-cylindrical surface 81 of the upper end 79 to define a second cylindrical passage for pivotally receiving the tilt pivot pin 50. This arrangement affords tilting or pivoting of the bracket 56 and the attached propulsion unit 12 in a generally vertical plane about the tilt axis 52.

The marine installation also comprises means for pivoting the bracket 56 about the tilt axis 52. While various pivoting means can be employed, in the illustrated construction, such means includes (see FIG. 1) a hydraulically actuated piston and cylinder assembly 96 positioned between the members 70 and 72 and pivotally interconnected between the transom 32 and the bracket 56. Suitable fluid supply means such as a fluid pump and a fluid reservoir (not shown) can be provided to actuate the piston and cylinder assembly.

Figure 5:
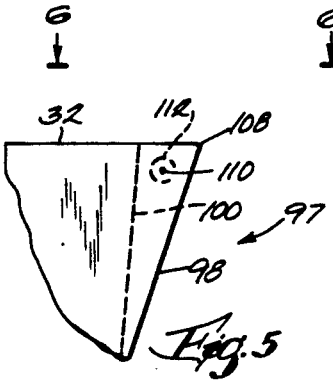
FIG. 5 is a side view of an alternative embodiment of the tilt pivot pin arrangement shown in FIG. 4.
Figure 6:
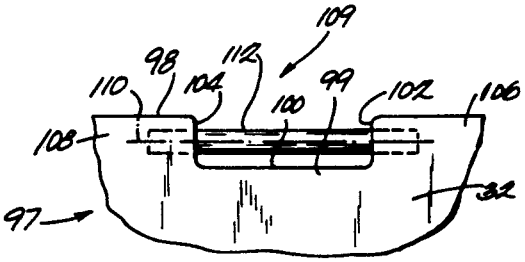
FIG. 6 is a view taken along line 6—6 in FIG. 5.

Illustrated in FIGS. 5 and 6 is a marine apparatus 97 that is an alternative embodiment of the invention. Except as described hereinafter, the marine apparatus 97 is substantially identical to the marine installation illustrated in FIGS. 1–4, and common elements have been given the same reference numerals.

In the marine apparatus 97, the transom 32 is not laminated and includes (see FIG. 6) a rearwardly facing outer surface 98, a lateral wall 99 defining a rearwardly facing recessed surface 100, and a pair of opposed sidewalls 102 and 104 extending inwardly or generally in the fore and aft direction from the outer surface 98 and terminating at the recessed surface 100. The sidewalls 102 and 104 and the outer surface 98 combine to at least partially define a pair of horizontally spaced apart, rearwardly extending projection 106 and 108.

The marine apparatus 97 also comprises means 109 connected to the walls 102 and 104 for supporting the propulsion unit 12 for pivotal movement relative to the boat 26 about a generally horizontal axis 110. As shown in FIG. 6, the axis 110 intersects the walls 102 and 104 and is located aft (above in FIG. 6) of the lateral wall 99. While various suitable supporting means 109 can be employed, in the illustrated construction, the means 109 includes a tilt pivot pin 112 extending along the axis 110 and between the walls 102 and 104. Preferably, the tilt pivot pin 112 includes opposite ends each integrated into a respective one of the walls 102 and 104. Alternatively stated, each of the opposite ends of the pivot pin 112 is integrated into a respective one of the projections 106 and 108.

The mounting bracket 56 is mounted on the pivot pin 112 and supports the propulsion unit 12 in the manner previously described. The cylindrical passages defined by the semi-cylindrical surfaces 80, 81, 88 and 92 constitute bearing means adapted to be connected to the boat walls 102 and 104, which extend generally perpendicular to the tilt axis 110.

Various of the features of the invention are set forth in the following claims.

We claim:

1. A mounting apparatus for mounting an outboard motor propulsion unit on a boat hull having a generally horizontal tilt pivot pin with a longitudinal axis, said mounting apparatus comprising a mounting bracket including means for supporting the propulsion unit for pivotal movement about a generally vertical steering axis, means for mounting said mounting bracket on the tilt pivot pin for pivotal movement about the longitudinal axis, said mounting means including a first pivot cap cooperating with said mounting bracket to define a first passage adapted to pivotally receive the tilt pivot pin, and means for releaseably fastening said first pivot cap on said mounting bracket.

2. A mounting apparatus as set forth in claim 1, wherein said mounting bracket and said pivot cap include respective first semi-cylindrical surfaces which cooperate to define said first passage.

3. A mounting apparatus as set forth in claim 2, wherein said mounting means includes a second pivot cap cooperating with said mounting bracket to define a second passage adapted to pivotally receive the tilt pivot pin, wherein said mounting bracket and said second pivot cap include respective second semi-cylindrical surfaces which cooperate to define said second passage, and wherein said mounting apparatus further comprises means for releaseably fastening said second pivot cap on said mounting bracket.

4. A mounting apparatus as set forth in claim 3, wherein the hull includes a transom, and wherein the tilt pivot pin is mounted on the transom.

5. A mounting apparatus as set forth in claim 1, wherein said mounting apparatus includes means for selectively pivoting said mounting bracket about the longitudinal axis.

6. A mounting apparatus as set forth in claim 5, wherein said means for selectively pivoting includes a piston and cylinder assembly pivotally interconnected between the hull and said mounting bracket.

7. A boat comprising a hull including a transom, and a pivot pin apparatus integrated into said transom and including a support member, a pair of horizontally spaced apart pivot pin supports each extending rearwardly from said support member and each including an outer end projecting outwardly from said transom, and a tilt pivot pin having a generally horizontal longitudinal axis, being adapted to support a marine propulsion unit for pivotal movement about said longitudinal axis, and extending between said outer ends.

8. A boat as set forth in claim 7, wherein said transom is at least partially comprised of laminations, and wherein said support member is a plate fixed between a pair of laminations.

9. A boat as set forth in claim 8 and further comprising a mounting apparatus adapted to support the outboard motor on said tilt pivot pin, and wherein said mounting apparatus includes a mounting bracket having means adapted for supporting the outboard motor for pivotal movement about a generally vertical steering axis, a pivot cap cooperating with said mounting bracket to define a passage pivotally receiving said tilt pivot pin, and means for releaseably fastening said pivot cap on said mounting bracket.

10. A boat as set forth in claim 9, wherein said mounting bracket and said pivot cap include respective semi-cylindrical surfaces which cooperate to define said passage.

11. A boat as set forth in claim 10, wherein said mounting apparatus includes means for selectively pivoting said mounting bracket about said longitudinal axis.

12. A boat as set forth in claim 11, wherein said pivoting means includes a piston and cylinder assembly pivotally interconnected between said transom and said mounting bracket.

13. Marine apparatus comprising a boat hull including opposed walls extending generally in the fore and aft direction, and means connected to said walls for supporting a propulsion unit for pivotal movement relative to said boat about a generally horizontal axis and about a steering axis transverse to said horizontal axis, said means including a mounting apparatus having therein a king pin bore defining the steering axis.

14. Apparatus as set forth in claim 13 wherein said means includes a tilt pivot pin extending along said axis and between said walls.

15. Apparatus as set forth in claim 14 wherein said tilt pivot pin includes opposite ends each integrated into a respective one of said walls.

16. Apparatus as set forth in claim 15 wherein said mounting apparatus is adapted to support an outboard motor on said tilt pivot pin and includes a mounting bracket having therein said king pin bore, a pivot cap cooperating with said mounting bracket to define a passage pivotally receiving said tilt pivot pin, and means for releaseably fastening said pivot cap on said mounting bracket.

17. Apparatus as set forth in claim 16, wherein said mounting bracket and said pivot cap include respective semi-cylindrical surfaces which cooperate to define said passage.

18. Apparatus as set forth in claim 17, wherein said mounting apparatus includes means for selecting pivoting said mounting bracket about said longitudinal axis.

19. Apparatus as set forth in claim 18, wherein said pivoting means includes a piston and cylinder assembly pivotally interconnected between said transom and said mounting bracket.

20. Apparatus as set forth in claim 13 wherein said axis intersects said walls.

21. Apparatus as set forth in claim 20 wherein said hull also includes a lateral wall extending between said opposed walls, and wherein said axis is located aft of said lateral wall.

22. Marine apparatus comprising a boat hull including opposed walls extending generally in the fore and aft direction, and means for supporting a propulsion unit for pivotal movement relative to said boat about a generally horizontal axis intersecting said walls and about a steering axis transverse to said horizontal axis, said means including a mounting apparatus having therein a king pin bore defining the steering axis.

23. Apparatus as set forth in claim 22 wherein said hull also includes a lateral wall extending between said opposed walls, and wherein said axis is located aft of said lateral wall.

24. Apparatus as set forth in claim 22 wherein said means is connected to said walls.

25. A mounting bracket for mounting an outboard motor propulsion unit on a boat for pivotal movement relative thereto about a generally horizontal tilt axis, said bracket comprising a portion having therein a king pin bore adapted to receive a king pin, and bearing means adapted to be connected to boat walls extending generally perpendicular to said tilt axis.

26. A boat comprising a hull including a transom having integrally and non-removeably therein a pair of horizontally spaced apart rearwardly extending projections, and a tilt pivot pin having a generally horizontal longitudinal axis, being adapted to support a marine propulsion unit for pivotal movement about said longitudinal axis, and extending between said projections.

27. A boat comprising a hull including a transom having a pair of horizontally spaced apart rearwardly extending projections, and a tilt pivot pin having a generally horizontal longitudinal axis, being adapted to support a marine propulsion unit for pivotal movement about said longitudinal axis, extending between said projections, and including opposite ends each integrated into one of said projections.

28. A boat as set forth in claim 27 and further comprising a mounting apparatus adapted to support the outboard motor on said tilt pivot pin, and wherein said mounting apparatus includes a mounting bracket having means adapted for supporting the outboard motor for pivotal movement about a generally vertical steering axis, a pivot cap cooperating with said mounting bracket to define a passage pivotally receiving said tilt pivot pin, and means for releaseably fastening said pivot cap on said mounting bracket.

29. A boat as set forth in claim 28, wherein said mounting bracket and said pivot cap include respective semi-cylindrical surfaces which cooperate to define said passage.

30. A boat as yet set forth in claim 29, wherein said mounting apparatus includes means for selectively pivoting said mounting bracket about said longitudinal axis.

31. A boat comprising a hull including a transom having laminations, a support plate fixed between a pair of said laminations, a pair of horizontally spaced apart pivot pin supports each extending rearwardly from said support plate and each including an outer end projecting outwardly from said transom, a tilt pivot pin having a generally horizontal longitudinal axis, and extending between said outer ends, a mounting apparatus adapted to support an outboard motor on said tilt pivot pin, said mounting apparatus including a mounting bracket having means for supporting the outboard motor for pivotal movement about a generally vertical steering axis, and a semi-cylindrical surface, a pivot cap including a semi-cylindrical surface which cooperates with said semi-cylindrical surface of said mounting bracket to define a passage pivotally receiving said tilt pivot pin, and means for releaseably fastening said pivot cap on said mounting bracket, and means for pivoting said mounting bracket about said longitudinal axis, said pivoting means including a piston cylinder assembly pivotally interconnected between said transom and said mounting bracket.

* * * * *